United States Patent [19]

Weisner

[11] Patent Number: 4,986,039

[45] Date of Patent: Jan. 22, 1991

[54] OPERATING-VENT GLASS-GLAZED STANDING-SEAM SKYLIGHT

[75] Inventor: Kent A. Weisner, Maitland, Fla.

[73] Assignee: SNE Enterprises, Inc., New York, N.Y.

[21] Appl. No.: 275,509

[22] Filed: Nov. 23, 1988

[51] Int. Cl.[5] ..... E04B 7/16

[52] U.S. Cl. ..... 52/72; 52/200

[58] Field of Search ..... 52/200, 208, 18, 58, 52/72; 49/483, 484, 485, 495

[56] References Cited

U.S. PATENT DOCUMENTS

| | | | |
|---|---|---|---|
| 4,570,302 | 6/1988 | Bechtold | 52/72 |
| 4,570,393 | 2/1986 | Minter | 52/200 X |
| 4,663,905 | 5/1987 | Schulz | 52/72 X |
| 4,776,141 | 11/1988 | Powell | 52/72 X |

OTHER PUBLICATIONS

Catalog, 8 pages, entitled "Sun-Tek Skylights".
Two-page Flier by Sun-Tek Skylights.
Four-page Brochure of Skymaster Skylights.
Twelve-page Brochure by Wasco Residential Skylights.
Twelve-page Brochure by Paeco Industries, Inc.
Velux Catalog, 1989 Edition, 28 pages.
Bristolite Skylights 1989, 20-page Catalog.
Fox Lite, Inc. Convertible Glass Skylight, four-page brochure.

*Primary Examiner*—David A. Scherbel
*Assistant Examiner*—Creighton Smith
*Attorney, Agent, or Firm*—Hill, Van Santen, Steadman & Simpson

[57] ABSTRACT

There is disclosed herein a skylight installation for a pitched roof having a planar section and for passing visible light from the ambient to the building interior while minimizing the ambient elements from entering the building through the skylight installation. The skylight unit includes a roof engaging mounting frame constructed to engage the planar roof section in a substantially coplanar manner and which defines a head end, a sill end and a pair of side edges. The side edges also include a pair of upstanding seam members for sealing to the roof. A sash is removably and hingedly connected to the mounting frame and carries a planar glass pane. Primary sealing means are associated with the frame for sealingly engaging the sash and secondary sealing means are provided in association with the frame for sealingly engaging the pane. The hinge includes one hinge element associated with the frame head member and a second hinge element associated with the sash head member. The hinge elements are removably and hingedly securable to one another. A novel weatherstripping and flow channel system is also provided. Aluminum extrusions are used for forming various frame and sash members. This assembly provides an effectively sealed low profile operating vent skylight unit.

22 Claims, 4 Drawing Sheets

58
58a
58b
58c
58d
22a
22
22b
22c
20
20a
20b
20c
20d
20e
20f
20g
20h
20i
28
39
32
56
72
52
48
54
59
38
50
46
70
30c
80

OPERATING-VENT GLASS-GLAZED STANDING-SEAM SKYLIGHT

BACKGROUND OF THE INVENTION

This application relates to a skylight assembly, and more particularly, to a vented or ventilating skylight assembly.

Vented or ventilating skylights are known for mounting to a roof over an opening in the roof to permit light and/or air to pass into the building interior. The skylight usually includes a roof-mounting frame that carries a pivotable sash, which in turn carries a transparent or translucent member, such as glass. The sash is connected to the frame by a hinge connection at one end, usually the upper end. At the other end, usually the lower end, an operator mechanism, such as an advanceable chain, is connected to the mounting frame and sash for separating the sash and mounting frame, thereby opening the skylight for ventilation. Reverse operation of the operator draws the sash and mounting frame together for closing the skylight.

Weatherstrips associated with the mounting frame and sash, seal the skylight closed to prevent leakage therethrough, seal deterioration, operation jamming, etc.

Water running down a roof can leak into the building where the skylight is joined to the roof when the junction is in the roof plane. This leakage has been minimized by building a curb to surround the roof opening and raise the junction above the roof plane. The skylight is mounted to the curb. The curb is sealed to the roof using known flashing and sealing techniques. The curb mounting system raises the skylight above the roof plane, which creates a high profile for the skylight, which can be esthetically unpleasing.

In U.S. Pat. No. 4,649,680 there is disclosed a standing seam sealing system for a fixed-in-position, non-venting plastic, dome-type skylight that is affixed to a roof. While this patent provides an effective form of sealing, it does not disclose a low profile venting skylight.

Therefore, it is an object of this invention to provide a sealed, but low profile operating skylight.

It is another object to provide a skylight which can be directly secured to a roof so as to avoid use of the curb.

Since existing skylight frames are usually rectangular, the weatherstripping is usually cut in four lengths, each equal to the length of a side, and then the weatherstripping is fitted to the frame with the seal ends either butting against each other or mitred at the skylight corners. This style of weatherstripping can result in leakage at the corner joints.

It is another object to provide a weatherstripping system for operating vent skylights which minimizes leakage.

Glass-glazed skylights are desirable since flat glass is readily available. Therefore, it is another object to provide a system for utilizing glass in an operating skylight of the type described above.

When installing a skylight, it is normally necessary for a contractor to climb a ladder or otherwise carry the skylight from the ground to the roof. A fully assembled skylight can be heavy and awkward to carry. Furthermore, in existing systems, in the event of a maintenance problem with the sash or transparent member of a mounted unit, it may be necessary to remove the entire skylight (i.e., frame and sash) from the roof. This can be difficult and costly.

It is therefore an object of this invention to provide a skylight which can be easily disassembled for carrying and/or service.

It is another object to permit the sash to be separated from the frame.

Skylights may conduct heat therethrough or otherwise not maximize performance.

It is another object of this invention to minimize thermal conductivity through the skylight and maximize the performance thereof.

These and other objects of this invention will become apparent from the following description and appended claims.

SUMMARY OF THE INVENTION

There is provided herein an operating-vent glass-glazed skylight, which has a low profile, can be directly mounted to the roof, can be effectively sealed to a roof, has a substantially continuous weatherstrip that avoids corner butting, has a sash that can be readily separated from the frame for ease of installation and service and which is constructed to maximize thermal performance.

Structurally, the skylight includes a mounting frame for direct and substantially coplanar mounting to a roof and for carrying the sash. The side edges of the frame each have an upstanding elongated standing seam member for sealing to the roof above the roof plane. The sash and frame each carry a mating part of a separable-type, knuckle-type hinge assembly for pivoting of the sash relative to the frame and for easy separation of the sash from the frame. The operator for opening and closing the skylight is attached to the frame and sash by a clevis-and-pin assembly so that the operator can be disconnected by removal of the pin from the clevis when the sash is to be removed. The sash defines means and is constructed to carry a flat glass member. There has also been provided a reliable single joint weatherstripping system. Moreover, the weatherstripping is arranged to minimize thermal conductivity through the skylight.

This skylight construction results in a sealed low profile venting skylight.

DESCRIPTION OF THE PREFERRED EMBODIMENT

Introduction

Figure 1:
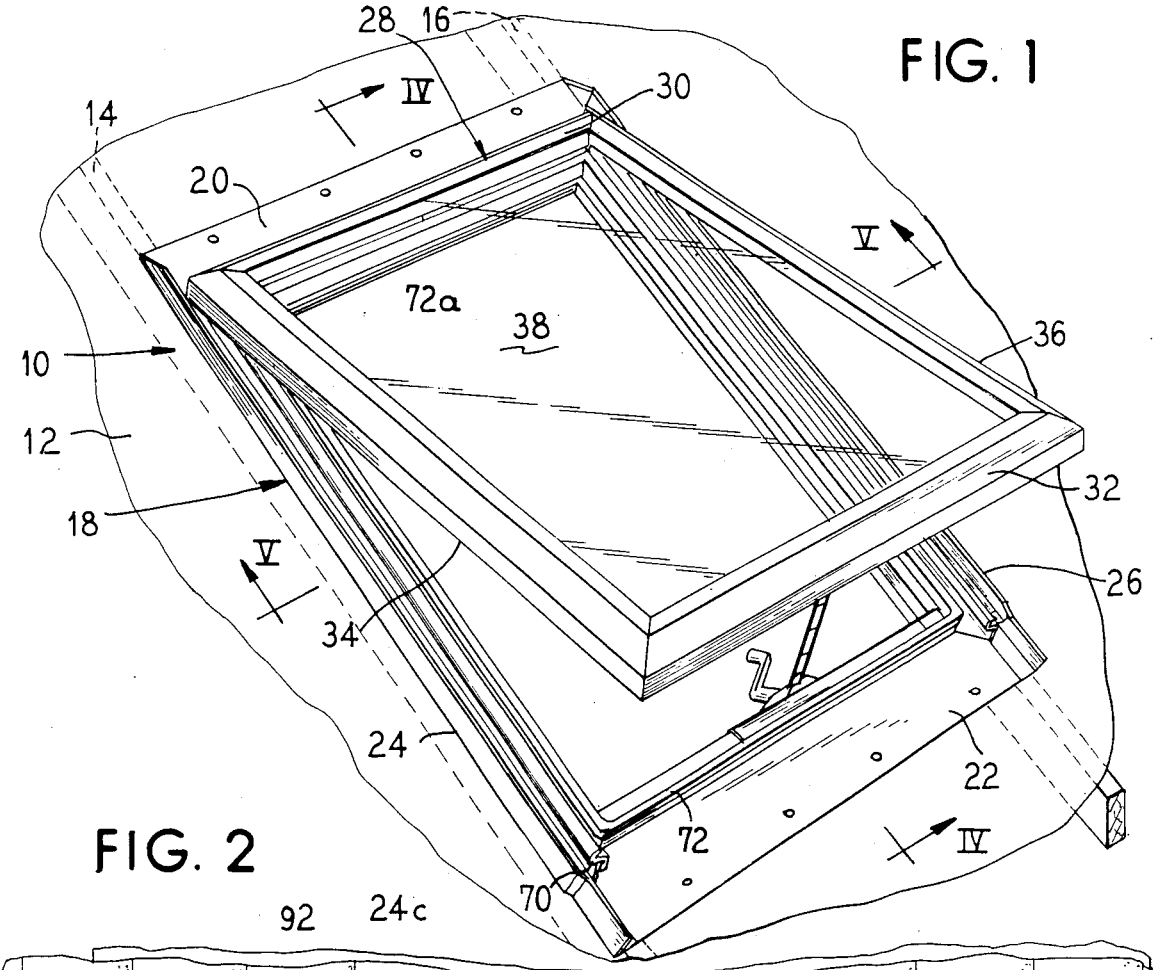
FIG. 1 is a perspective style view showing the skylight unit of this invention in the opened position and for mounting in a pitched style roof.
Figure 2:
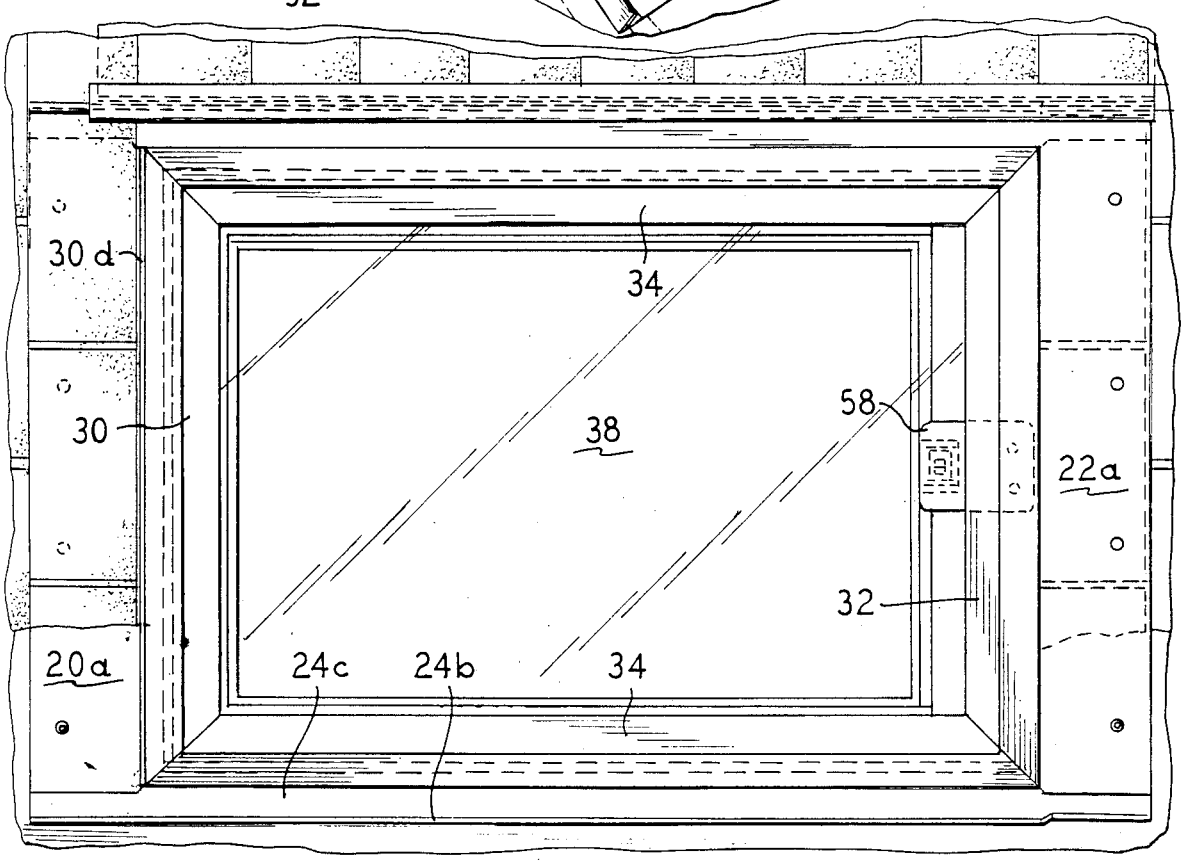
FIG. 2 is a top plan view of a closed skylight.
Figure 3:
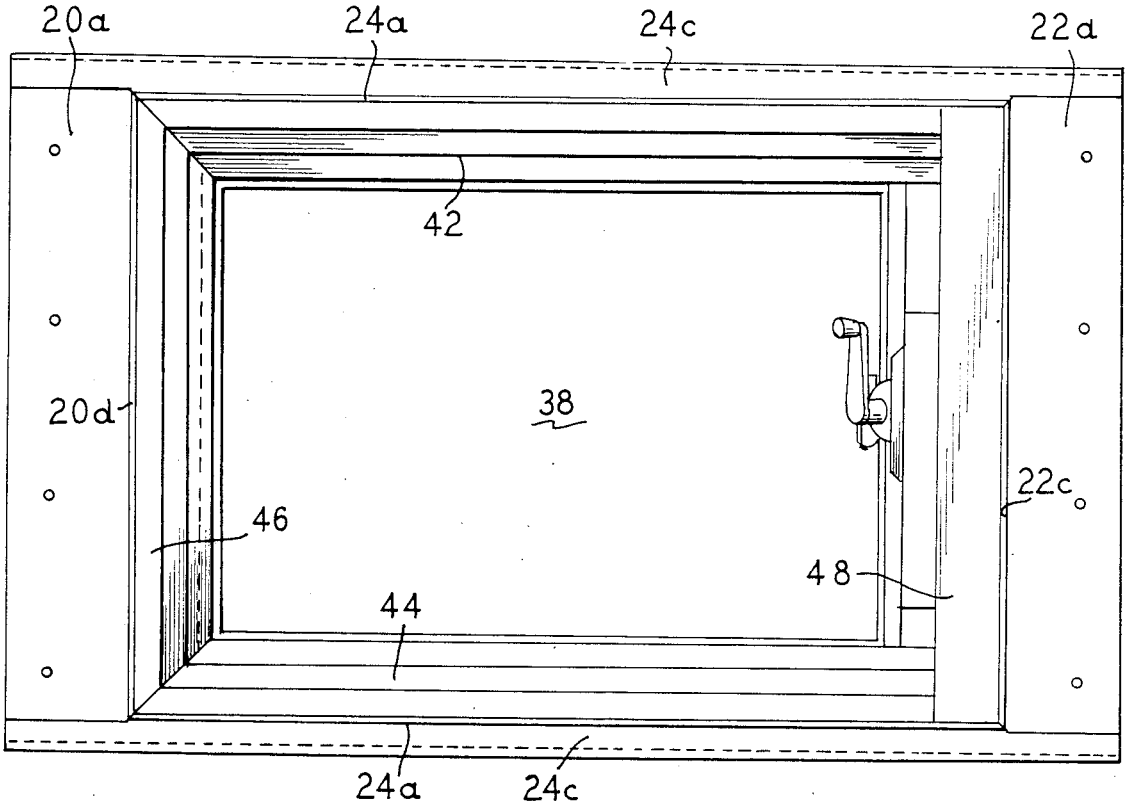
FIG. 3 is a bottom plan view of a closed skylight.

Referring now to the drawings, FIG. 1 shows an operating-vent, standing-seam, glass-glazed skylight 10 generally, mounted in a pitched roof 12 between a pair of roof carrying trusses, such as 14 and 16.

The Frame and Sash

The roof-engaging or skylight mounting frame 18 is rectangular or of another polygonal shape and is fabricated of aluminum extrusions or members including a head member 20, sill member 22 and elongated side members or jambs 24 and 26. The sash member 28 is also rectangularly shaped and is fabricated of aluminum extrusions, such as head member 30, sill member 32 and a pair of elongated side members or stiles 34 and 36. The sash members form an inner frame for carrying a glass pane 38, which is bonded to the sash by an appropriate adhesive. The frame and sash are interconnected by a hinge assembly and an operator, as described hereinafter.

The Frame and Extrusions

Figures 4, 4A, 6, 7:
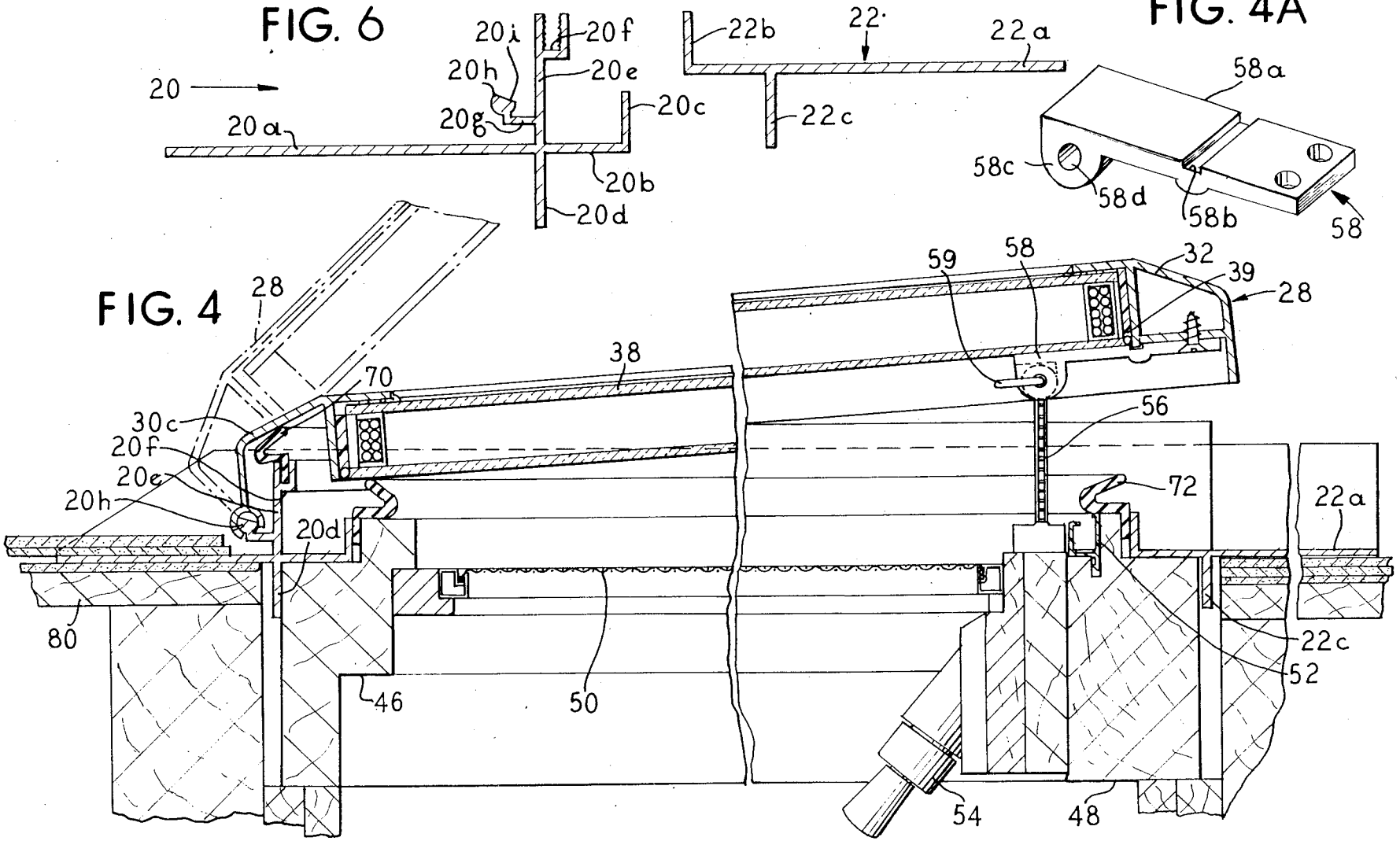
FIG. 4 is a vertical cross-section taken along line IV—IV of FIG. 1 showing the skylight opened and in chain-dotted lines the sash positioned for separation.
FIG. 4A is an enlarged perspective view of the clevis as in FIG. 4.
FIG. 6 is a cross-section of the frame head member showing a part of the knuckle hinge.
FIG. 7 is a cross-section of the frame sill member.

FIG. 6 shows the head member 20 for the frame 18. The head member 20 is generally cross-shaped and includes an outer elongated roof engaging flashing member **20*a* and an inner leg 20*b* having an upstanding inner channel forming and weatherstrip engaging flange 20*c*. Vertically, there is provided a downwardly extending or depending inner frame forming flange 20*d* and an upwardly extending leg 20*e*. The upper leg 20*e* includes an inwardly positioned channel-shaped secondary weatherstrip-receiving-trough 20*f* and an outwardly extending hinge carrying leg 20*g* on which a cylindrical male part 20*h* for a knuckle-type hinge is carried and spaced from the upright 20*e*. The hinge member 20*h* is a generally cylindrical member having a diameter of about 0.250 inch and a flat or land 20*i***.

The land **20*i*** is oriented at about 20° to the plane of the skylight The perpendicular distance from the land through the center to the opposite side of the knuckle is about 0.200 inch.

The lower frame or sill member 22, as shown in FIG. 7, is generally L-shaped and includes a wide roof-engaging outer flashing-like web **22*a* and an upstanding weatherstrip engaging flange 22*b*, which is carried along one edge of the flashing. A depending web 22*c*** extends downwardly from said web for cooperation in defining an inner frame and carrying a decorative inner wooden frame or moulding.

Figure 8:
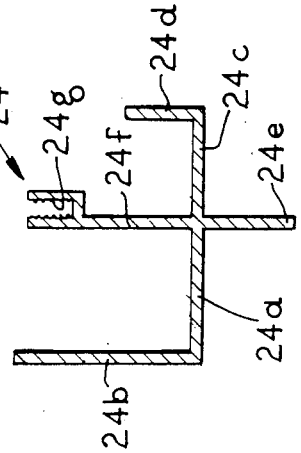
FIG. 8 is a cross-section of the side member of the frame showing the standing seam member.

The side or jamb members, such as 24 in FIG. 8, define a generally cross-shaped member having an outer or flashing leg **24*a*, which terminates in the upstanding standing seam or outer channel forming member 24*b*. The inner leg 24*c* terminates in a short upstanding inner channel forming and weatherstrip engaging flange 24*d*. The depending leg 24*e* cooperates in positioning the skylight in the roof, cooperates in defining the inner frame and carrying the decorative inner frame The upstanding central leg 24*f* includes a weatherstrip carrying channel 24*g*. The other side rail is exactly the same extrusion except that it is provided on the opposite side. It is to be noted from FIG. 1** that the standing seam is bent inwardly slightly at its lower end so as to provide a telescoping end adapted to interfit with the upper end of an adjacent skylight.

The frame is formed by joining (as by welding) the head member 20, sill member 22, and side or jamb members 24 and 26 together When the frame is formed, the seal receiving troughs, such as **24*g* and 20*f*, form a U-shaped primary seal receiving trough along the sides and head of the frame and the depending legs, such as 20*d*, 22*c* and 24*e*, form an inner frame for fitting in the roof opening and to which a decorative inner wooden frame is fitted. The flashings and legs 20*a*, 24*a* and 22*a*** form a rectangular roof-engaging surface that is substantially coplanar with the roof.

An outer or primary inverted and U-shaped flow channel is formed by the head member portions **20*a*, 20*e* and the side member portions such as 24*b*, 24*a* and 24*f*. An inner or secondary inverted and U-shaped flow channel is formed by the head member portions 20*e*, 20*b* and 20*c* and side member portions such as 24*f*, 24*c* and 24*d*. Note that the inner flow channel is inward of the primary weather seal trough, such as 20*f* and 24*g***, and terminates to the exterior side of the skylight.

The Sash and Extrusion

Figure 11:
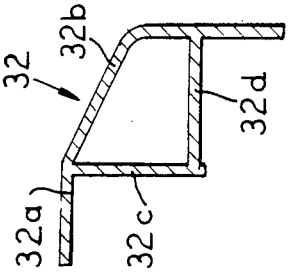
FIG. 11 is a cross-section of the sill member of the sash.
Figure 10:
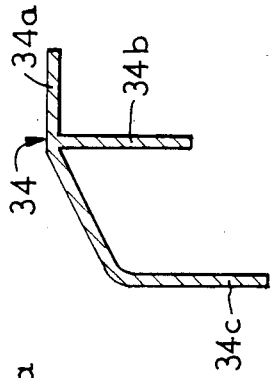
FIG. 10 is a cross-section of the side members of the sash.
Figure 9:
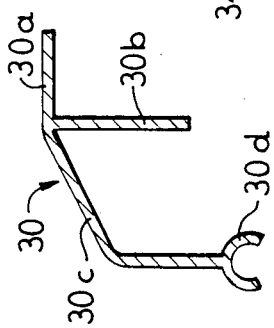
FIG. 9 is a cross-section of the sash head member showing a part of the knuckle hinge assembly.
Figure 5:
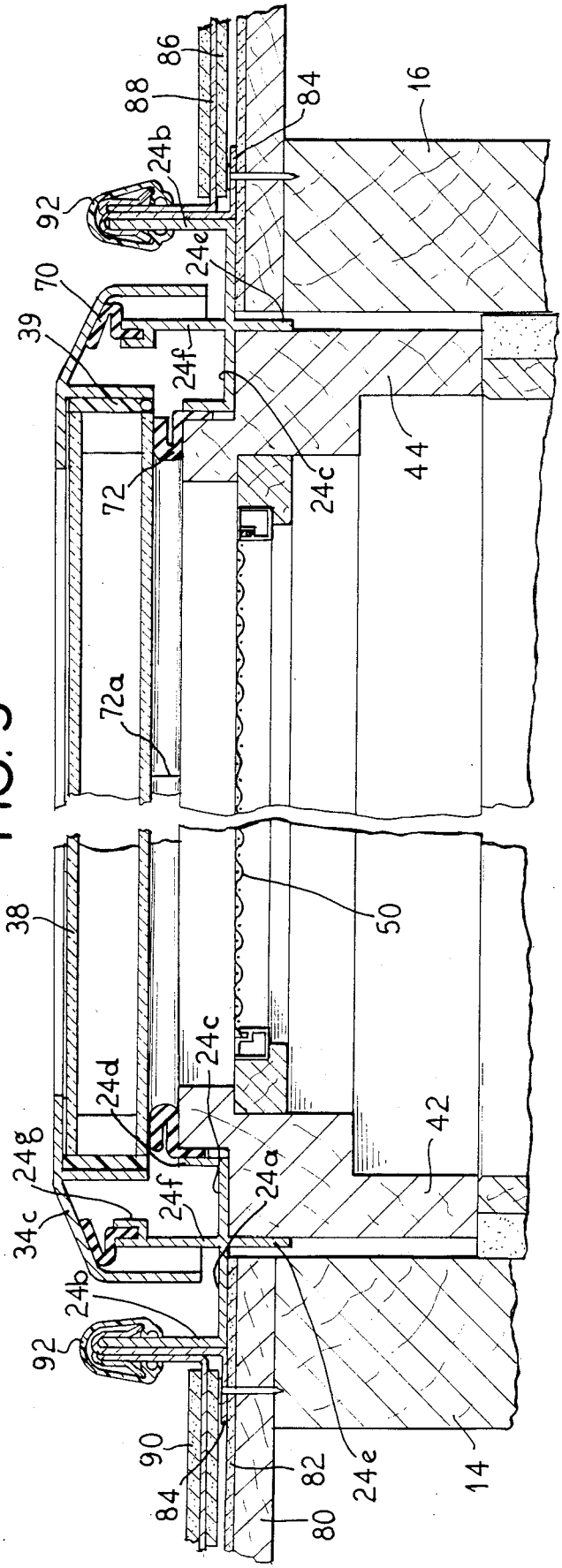
FIG. 5 is a vertical cross-section taken along line V—V of FIG. 1, but with the skylight closed.

The sash members are shown in section in FIGS. 9, and 11 and are shown assembled in the other drawings, such as FIGS. 4 and 5.

The sash head member is formed from the extrusion 30 as in FIG. 9 The extrusion 30 includes the inner frame forming leg **30*a*, the depending retaining frame leg 30*b*, and the angularly and depending outer hood-like leg 30*c* which terminates in the female hinge part 30*d*** of the knuckle-type hinge. The female part is a downwardly open C-shaped member which is open at an angle of about 120° and is about 0.250 inch in diameter.

The side or stile members for the sash are formed from the same extrusion and include an inner frame-forming leg **34*a*, a depending web forming the retaining frame 34*b*, and the angularly and depending hood-shaped leg 34*c***.

The sash sill 32 is formed of an extrusion having an inner frame forming leg **32*a*, the hood-like section 32*b*, inner leg 32*c*, and web 32*d* which connects the leg 32*c* and hood 32*b***.

It is understood that these extrusions are welded together so as to form an inner rectangularly shaped glass retaining frame with legs such as **32*c*, 30*b*, and 34*b*. An insulating glass assembly, such as 38 is positioned within the retaining frame formed by the legs 30*b*, 32*c* and 34*b* and is bonded in position by an adhesive such as structural silicone 39 (see FIG. 4**).

The Wooden Interior Frame

A decorative wooden interior frame formed of rails or stiles, such as 42, 44, 46 and 48, is fitted into the inner retaining frame formed by the mounting frame depending legs such as **20*d*, 22*c*, and 24*e*. The inner wooden frame is for cooperation with flanges, such as 24*d***, in positioning a primary or outer weather seal, for decorative appearance and for supporting the operator, screen and shade accessories. The wooden frame is secured to the metal frame by screws or similar fasteners. The interior of the wooden frame is provided with bored holes with releasable locking mechanisms (e.g., spring-loaded plungers) for securing a screen such as 50 across the opening for the skylight.

A drip channel such as 52 is secured and positioned in the wooden frame at the sill end 48 for catching condensate dripping from the pane 38 and for evaporation thereof.

The operator 54 is secured to the wooden frame sill and in operation advances the chain 56, which is secured at one end to the clevis assembly 58 on the sash by a pin 59.

The Clevis

The clevis 58 as shown in FIG. 4A is an elongated but narrow and thin member, which is secured by screws to the sash sill member and lies against the insulated glass assembly The clevis is made of nylon or other low-thermal conductivity plastic. The clevis has thin narrow body channel-like recess **58*b* is provided to accommodate the edge of the sash-sill wall 32*c***.

The head **58*c* extends downwardly from the body and includes a pin receiving bore 58*d* for receiving and cooperating with the pin 59 This clevis construction could conduct thermal energy between the weather side of the skylight and the building interior by contacting the sash sill 32** and the interior. However, the size and material of the clevis and the inner or secondary weatherstripping minimize thermal transfer.

The Seals

There are provided two seals in this assembly, the first one being the outer or primary seal and the second being the inner or secondary seal.

The primary seal 70 is a U-shaped, one piece weatherstrip and positioned in the seal receiving troughs such as **24*g* and 20*f* (see FIGS. 2, 3, 4 and 5). The primary seal forms a substantially inverted U-like shape as it extends upwardly along one side across the head member and downwardly along the other side of the skylight. The outer or primary seal 70 is positioned to engage the inner surface of the hoods of the sash member, such as 34*c* and 30*c***, to provide the sealing.

The inner seal or secondary seal 72 has a square-shaped periphery and is positioned between the inner legs of the extrusions, such as **20*c*, 22*b* and 22*d*, and their respective wooden frame members such as 42, 44, 46 and 48. The seal 72 is arranged so as to have only a single seam or junction 72*a* and that is usually positioned in the center of the head end of the frame. Thus there is no mitring and the seal member, in effect, turns the corners with the only seal-to-seal junction being at the center of the head. The seal is positioned to sealingly engage the pane 38** so as to minimize exterior moisture from entering the building interior through the skylight However, where the clevis is positioned, the seal engages the clevis, not the pane.

The inner or secondary flow channel formed by the head and side members is positioned between the primary and secondary weatherstrips.

Installation

Referring now to FIG. 5, a standing seam unit is shown installed in a roof The roof includes trusses, such as 14 and 16, which carry the roof decking, such as 80. Roofing felt 82 is secured to the decking and an L-shaped anchor 84, of the type shown in U.S. Pat. No. 4,649,680, is secured to the roof by nailing and engages the standing seam member, such as **24*b*. A row of shingling 86 is applied over the anchor and then an L-shaped flashing member 88 is applied to the shingle and abuts the standing seam. Another row of shingling 90 is placed thereover. Appropriate sealants may be applied to the various seam members and a batten or weather cap 92** is applied thereover.

The frame head wall **20*e* diverts water flowing down the roof to a flow channels such as those formed by the standing seam 24*b* and central web 24*f* and leg or floor 24*a***.

Installation and Operation

In order to install the skylight, the sash can be separated from the frame by removal of the clevis pin 59 and rotation of the sash 28 to a position where the female hinge part opening and male hinge part land are aligned so as to permit removal of the sash from the frame. This is shown in FIG. 4 in chain-dot lines This generally occurs at about 45° to the plane of the skylight The unit can then be carried onto the roof in two parts, namely the sash and the frame, and then installed and reassembled. The frame is mounted to the roof and the sash remounted to the frame, rotated downwardly and the operator reconnected by insertion of the pin 59. The unit is openable by operating the operator 54 to cause the chain 56 to advance, thereby separating the sash from the frame. Closure is achieved by reverse operation of the operator so as to draw the sash against the frame In the closed condition, the primary seal 70 engages the sash hoods for sealing and the secondary seal 72 engages the pane 38 and clevis so as to maximize sealing.

In the open position, light can pass through the skylight pane 38 and to the interior of the building, and air passes into the skylight through the screen and into the interior of the building In the closed position, light passes through the closed sash and pane 38, while air, water and the like are sealed from entry by the primary and secondary weatherstrips.

Water flowing down the roof primarily flows to the outer channel and downwardly therethrough. The standing seam seals the skylight to the roof so as to minimize leakage. In the event water were to penetrate the primary seal or drip from hood parts, such as **30*c* or 30*b*, it could be collected and disposed of via the inner or secondary channel, such as formed by head parts 20*c*, 20*b* and 20*e*, or side member parts 24*d*, 24*c* and 24*f***.

The units by virtue of this construction provide a low profile relative to the roof in that they do not extend significantly above the roof line. In this embodiment, the uppermost part of the skylight is only about two inches above the roof.

Skylight Ganging

Figure 12:
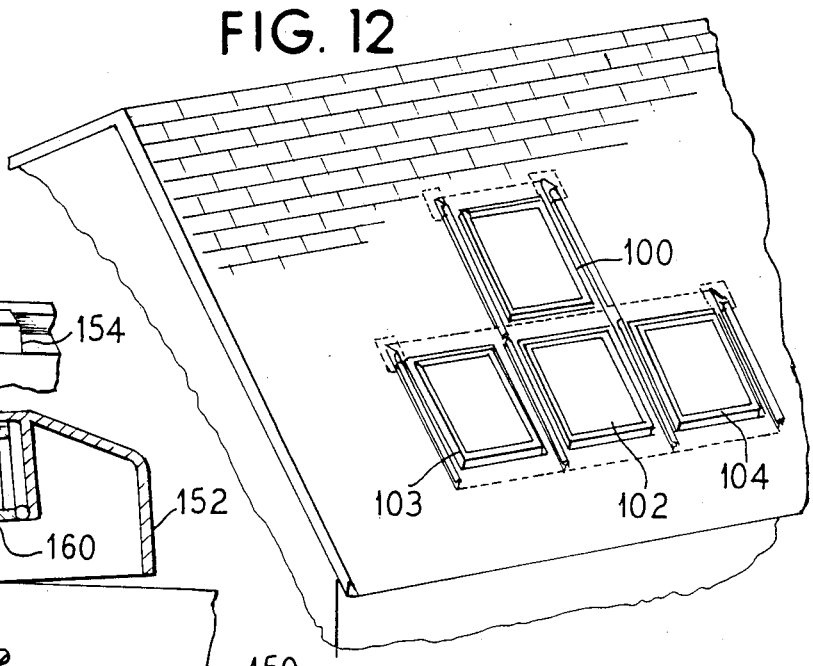
FIG. 12 shows horizontal and vertical ganging of a plurality of skylight units on a pitched roof.

The vertical and horizontal ganging of skylights is shown in FIG. 12. There the upper skylight 100 is fitted into the lower skylight 102 by overlapping and telescoping the standing seam members Horizontally the skylights 103 and 104 are positioned side-by-side with skylight 102 on the appropriate roof trusses and with the standing seam members abutting each other and sealed together.

Alternative Clevis

Figure 13:
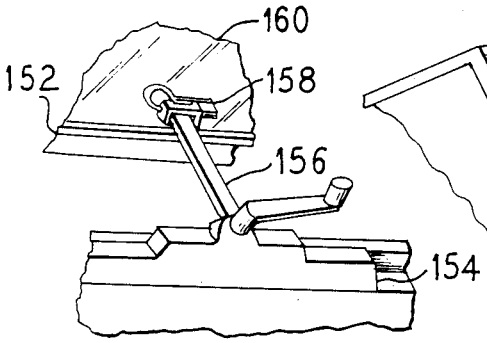
FIG. 13 is a perspective-style view showing fragmentary portions of the frame and sash and an alternative connection operator.
Figure 14:
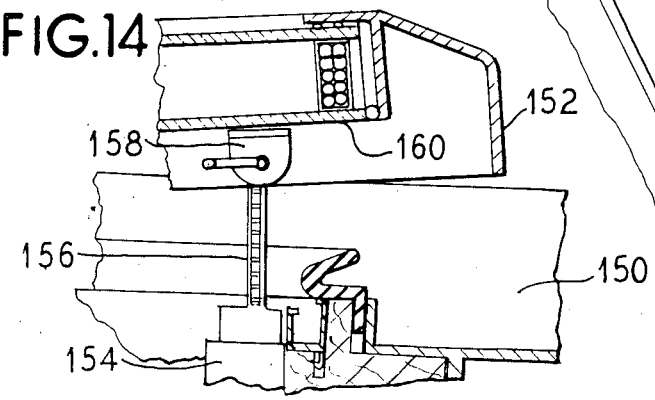
FIG. 14 is a vertical sectional view of a fragment of an opened skylight with the alternative connection.

FIGS. 13 and 14 show an alternative clevis construction. A mounting frame 150 and a movable glazed sash 152 are separated by the cooperation of an operator 154, chain 156 and pinned clevis 158 In this case the clevis is adhesively bonded to the sash glazing 160. In this system the clevis is on the interior or building side of the skylight and thus there is no thermal path via the clevis between the inside and outside of the skylight. Thus performance of the skylight can be further increased.

Although the invention has been described with respect to preferred embodiments, it is not to be so limited as changes and modifications can be made which are within the full intended scope of the invention as defined by the appended claims.

We claims as our invention:

1. A skylight for installation in a pitched roof having a planar section, said skylight having an upper end and a lower end and for passing visible light from the ambient to a building interior while minimizing ambient elements from entering a building through the skylight installation, said skylight comprising:

mounting means for securement to a planar roof section;

sash means for transmitting visible light therethrough pivotally connected to said mounting means;

opening means associated with said mounting means and sash means for controllably separating said sash means relative to said mounting means to permit ambient air to pass through said skylight installation; and means for sealing said mounting means to said roof section;

wherein the improvement comprises:

said sash means includes light-transmitting pane means and means for carrying said pane means;

said mounting means including substantially planar frame means constructed to engage a planar roof section in a substantially coplanar manner and having a pair of side edges;

said opening means including:

hinge means associated with the mounting frame and said sash at the upper end of the skylight, and operator means associated with the lower end of the frame and the sash for moving said sash means between an open position and a closed position relative to said frame means;

primary sealing means associated with said frame means for sealingly engaging said sash means;

secondary sealing means associated with said frame means for sealingly engaging said pane means; and said roof sealing means including elongated, upstanding seam means along an outer edge of said side edges of said frame means; and wherein said skylight includes an internal wood member and a condensate gutter arrangement, said member constructed to carry the condensate gutter arrangement positioned such that liquid on said pane drips into said gutter and is evaporable therefrom.

2. A skylight for installation in a pitched roof having a planar section, said skylight having an upper end and a lower end and for passing visible light to a building interior while minimizing ambient elements from entering a building through the skylight installation, said skylight comprising:

mounting means for securement to a planar roof section;

sash means for transmitting visible light therethrough pivotally connected to said mounting means;

opening means associated with said mounting means and sash means for controllably separating said sash means relative to said mounting means to permit ambient air to pass through said skylight installation; and means for sealing said mounting means to said roof section;

wherein the improvement comprises;

said sash means includes light-transmitting pane means and means for carrying said pane means;

said mounting means including substantially planar frame means constructed to engage a planar roof section in a substantially coplanar manner and having a pair of side edge members;

said opening means including:

hinge means associated with the mounting frame and said sash at the upper end of the skylight, and operator means associated with the lower end of the frame and the sash for moving said sash means between an open position and a closed position relative to said frame means;

primary sealing means associated with said frame means for sealingly engaging said sash means;

secondary sealing means associated with said frame means for sealingly engaging said pane means; and said roof sealing means including elongated, upstanding seam means along an outer edge of said side edges of said frame means; and wherein said upstanding seam is spaced outwardly from said primary seal means so as to define a primary flow channel therebetween;

wherein said frame means includes a head frame member, said head member having an upwardly extending wall for diverting water flowing thereagainst to the flow channels; and wherein said frame includes means associated with said head member and side edge members which define an inner and secondary inverted and U-shaped flow channel positioned inwardly of the primary flow channel.

3. A skylight as in claim 2, wherein said inner and secondary flow channel is positioned inwardly of the primary sealing means and outwardly of the secondary sealing means.

4. A low-profile operating-vent glass-glazed skylight of the type having a frame for substantially coplanar mounting to a pitched roof, a sash including a light-transmitting means, a hinge for hingedly securing the sash to the frame at one end and an operator, at the other end of the frame, for opening and closing the sash relative to the frame wherein:

said hinge including a plurality of separable members;

said operator having a mechanism portion fixedly secured to the frame and a free end extendable from and retractable into said mechanism and releasably securable to said sash; and a securement member fixedly secured to said sash for ready and releasable securement to the free end of said operator wherein the sash securement member has a clevis-like shape and there is further provided pin members for cooperation with said operator free end and sash securement member for securing said operator to said sash and for separation of the operator and securement means;

so that said sash can be removed from said frame by release of the operator from the sash securement member and separation of the hinge.

5. A system as in claim 4, wherein the clevis-like shaped securement member is bonded to the sash.

6. A skylight as in claim 5, wherein said clevis is adhesively bonded to said pane means.

7. A skylight as in claim 5, wherein said clevis is mechanically secured to said sash means.

8. A low-profile operating-vent glass-glazed skylight as in claim 4, wherein said hinge member includes an inner cylindrically-shaped male portion associated with said frame and an outer female portion associated with the sash having a generally complementary cylindrical shape for receiving and hingedly engaging said male member and having an open segment.

9. A low-profile operating-vent glass-glazed skylight as in claim 8, wherein the female portion of said hinge is generally C-shaped and includes spaced shoulders positioned so as to define a normally downwardly directed opening.

10. A low-profile glass-glazed skylight an in claim 4, wherein said skylight is constructed to be mounted to a pitched roof wherein the hinge end is positioned at the head end of the skylight.

11. A skylight as in claim 4, wherein said operator is mounted to said frame at the sill end thereof.

12. An apparatus as in claim 4, wherein said hinge means includes a C-shaped female member associated with one of said sash means and frame means and a cylindrical member having a flat side associated with the other of said sash means and frame means, said C-shaped female member and said flat-sided male member adapted to releasably interengage one another and for rotation of said sash means about an axis defined by said male and female members.

13. A skylight as in claim 12, wherein said C-shaped knuckle member of said hinge has an inside diameter slightly greater than the outside diameter of the cylindrical male shape, the opening of the C-shape is less than the diameter of said male member and is approximately equal to the distance between the flat on said male member and the curved surface of the male member so as to permit the female member to be removably mounted to the male member.

14. A low-profile operating-vent skylight as in claim 4 wherein:

said frame includes a pair of longitudinal side flashing-like surfaces for engagement with a roof surface, and each of said side surfaces having a generally vertically oriented wall-like standing seam member which extends longitudinally along the side edge and is spaced from said sash member but generally parallel thereto and extends between the head and sill ends of the skylight.

15. A low-profile glass-glazed standing-seam skylight as in claim 14, wherein the bottom end of each standing seam member is displaced inwardly so as to permit telescopic nesting with another standing seam skylight positioned therebelow.

16. A low profile operating vent skylight as in claim 4 wherein:

said light-transmitting means includes light-transmitting pane means;

said mounting means including substantially planar frame means constructed to engage a planar roof section in a substantially coplanar manner and having a pair of side edges;

primary sealing means associated with said frame means for sealingly engaging said sash means;

secondary sealing means associated with said frame means for sealingly engaging said pane means; and said roof sealing means including elongated, upstanding seam means along an outer edge of said side edges of said frame means.

17. A skylight as in claim 16, wherein said secondary sealing means includes rectangularly shaped peripheral seal supporting means on said frame means and polymeric seal means extending from said head end along one side edge, along the lower end, along the other side edge and along the upper end, said seal means being free of corner joints, being one piece and having ends joined at one end.

18. A low-profile operating-vent glass-glazed skylight of the type having a frame for substantially coplanar mounting to a pitched roof, a sash including a light-transmitting means, a hinge for hingedly securing the sash to the frame at one end and an operator, at the other end of the frame, for opening and closing the sash relative to the frame wherein:

said hinge including a plurality of separable members;

said operator having a mechanism portion fixedly secured to the frame and a free end extendable from and retractable into said mechanism and releasably securable to said sash; and a securement member fixedly secured to said sash for ready and releasable securement to the free end of said operator;

so that said sash can be removed from said frame by release of the operator from the sash securement member and separation of the hinge;

wherein said hinge member includes an inner cylindrically-shaped male portion associated with said frame and an outer female portion associated with the sash having a generally complementary cylindrical shape for receiving and hingedly engaging said male member and having an open segment;

wherein the female portion of said hinge is generally C-shaped and includes spaced shoulders positioned so as to define a normally downwardly directed opening; and wherein said male member includes a flat or lank part and the distance across the land is less than the distance defining the open segment of the C-shaped female part.

19. A low-profile operating-vent glass-glazed skylight of the type having a frame for substantially coplanar mounting to a pitched roof, a sash including a light-transmitting means, a hinge for hingedly securing the sash to the frame at one end and an operator, at the other end of the frame, for opening and closing the sash relative to the frame wherein:

said hinge including a plurality of separable members;

said operator having a mechanism portion fixedly secured to the frame and a free end extendable from and retractable into said mechanism and releasably securable to said sash; and a securement member fixedly secured to said sash for ready and releasable securement to the free end of said operator;

so that said sash can be removed from said frame by release of the operator from the sash securement member and separation of the hinge;

wherein said hinge member includes an inner cylindrically-shaped male portion associated with said frame and an outer female portion associated with the sash having a generally complementary cylindrical shape for receiving and hingedly engaging said male member and having an open segment;

wherein the female portion of said hinge is generally C-shaped and includes spaced shoulders positioned so as to define a normally downwardly directed opening; and wherein the flat land portion on the male part of the hinge is oriented at an angle of about 20° to the plane of the frame, and the open segment of the female part defines an arc of about 120° and the separation of the sash from the frame is achieved when the sash is oriented at an angle of about 45° to the frame where the female part opening is aligned with the flat land on the male part.

20. A skylight for installation in a pitched roof having a planar section, said skylight having an upper end and a lower end and for passing visible light from the ambient to a building interior while minimizing ambient elements from entering a building through the skylight installation, said skylight comprising:

mounting means for securement to a planar roof section;

sash means for transmitting visible light therethrough pivotally connected to said mounting means;

opening means associated with said mounting means and sash means for controllably separating said sash means relative to said mounting means to permit ambient air to pass through said skylight installation; and means for sealing said mounting means to said roof section;

wherein the improvement comprises:

said sash means including light-transmitting pane means and means for carrying said pane means;

said mounting means including substantially planar frame means constructed to engage a planar roof section in a substantially coplanar manner and having a pair of side edges;

said opening means including:

hinge means associated with the mounting frame and said sash at the upper end of the skylight; and operator means associated with the lower end of the frame and the sash for moving said sash means between an open position and a closed position relative to said frame means;

primary sealing means associated with said frame means for sealingly engaging said sash means;

secondary sealing means associated with said frame means for sealingly engaging said pane means; and said roof sealing means including elongated, upstanding seam means along an outer edge of said side edges of said frame means;

wherein said secondary sealing means includes rectangularly shaped peripheral seal supporting means on said frame means and polymeric seal means extending from said head end along one side edge, along the lower end, along the other side edge and along the upper end, said seal means being free of corner joints, being one piece and having ends joined at one end; and wherein said primary seals means between said sash means and said frame means define an elongated seal receiving channel along the side edges and upper end of said frame and a one-piece, inverted U-shaped seal means positioned within said channel and extending along one side edge, across the upper end and along said other side edge for providing sealing engagement between said sash and frame.

21. A low-profile operating-vent skylight for use on a pitched roof which skylight includes:

a mounting frame having head, sill and side members for coplanar mounting on the roof;

a sash having head, sill and side members and a glass glazing;

a hinge at the head end of the mounting frame and sash for hingedly securing the sash to the mounting frame;

an operator having a mechanism end secured to the frame sill and advanceable means secured to the sash adjacent the sill end thereof and in movable cooperation with said operator mechanism, wherein said frame includes a plurality of extruded metal members joined together and shaped to form a roof engaging means;

primary inverted U-shaped seal holding means for engaging said sash frame and secondary rectangularly shaped glass-glazing engaging seal support means spaced inwardly thereof, a pair of standing seam water diversion members each positioned along a side edge of the mounting frame spaced outwardly of the sash and parallel thereto and extending between the head and sill members of the mounting frame;

said sash primary seal means mounted to the frame in the inverted U-shaped channel holding means and seal means in the secondary channel having a single butting joint at the head end thereof and adapted to turn the corners of the seal, said seal being spaced outwardly of the sash, said sash having hood-like extruded members for overlying said seal members and protecting said seal members from the ambient and for carrying said glass glazing and interfitting with the seal members in a nesting-like arrangement.

22. A skylight as in claim 21, wherein the sill ends of the standing seam member are displaced inwardly so as to permit a nesting relationship with other skylights.

* * * * *